US011198577B2

(12) United States Patent
Falzon et al.

(10) Patent No.: US 11,198,577 B2
(45) Date of Patent: Dec. 14, 2021

(54) SYSTEM AND METHOD FOR PICKING SINGLE SHEET OF MATERIAL FOR FURTHER PROCESSING

(71) Applicant: Under Armour, Inc., Baltimore, MD (US)

(72) Inventors: John Francis Falzon, Baltimore, MD (US); Jack Dorman, Andalusia, AL (US)

(73) Assignee: UNDER ARMOUR, INC., Baltimore, MD (US)

( * ) Notice: Subject to any disclaimer, the term of this patent is extended or adjusted under 35 U.S.C. 154(b) by 176 days.

(21) Appl. No.: 16/403,717

(22) Filed: May 6, 2019

(65) Prior Publication Data

US 2019/0337745 A1 Nov. 7, 2019

Related U.S. Application Data

(60) Provisional application No. 62/667,177, filed on May 4, 2018.

(51) Int. Cl.

| | |
|---|---|
| ***B65H 7/18*** | (2006.01) |
| ***B65H 7/14*** | (2006.01) |
| ***B65H 3/22*** | (2006.01) |
| ***B65H 3/02*** | (2006.01) |
| ***B65H 3/00*** | (2006.01) |

(52) U.S. Cl.

CPC ..... *B65H 7/18* (2013.01); *B65H 3/00* (2013.01); *B65H 3/02* (2013.01); *B65H 3/22* (2013.01); *B65H 7/14* (2013.01); *B65H 2701/174* (2013.01)

(58) Field of Classification Search

CPC ... B65H 7/14; B65H 7/18; B65H 3/00; B65H 3/02; B65H 3/22; B65H 2701/174

See application file for complete search history.

(56) References Cited

U.S. PATENT DOCUMENTS

| | | | | |
|---|---|---|---|---|
| 3,588,091 | A | 6/1971 | Stone, III et al. | |
| 3,747,919 | A | 7/1973 | Stewart et al. | |
| 3,902,750 | A | 9/1975 | Roitel | |
| 4,579,331 | A | 4/1986 | Nestler et al. | |
| 4,601,463 | A * | 7/1986 | Goto | B65H 3/54 271/18.3 |
| 4,641,827 | A | 2/1987 | Walton et al. | |

(Continued)

*Primary Examiner* — Patrick Cicchino

(74) *Attorney, Agent, or Firm* — Edell, Shapiro & Finnan LLC

(57) ABSTRACT

A single material sheet is picked from a support member. A gripping member is aligned above the support member, where the gripping member includes a pair of spaced apart pinching members movably coupled with a main frame, and each pinching member includes an exposed gripping surface that is substantially planar and that faces an exposed surface of the material sheet. The gripping member is moved a first distance toward the exposed surface of the material sheet such that the gripping surfaces of the pinching members engage a portion of the material sheet. The pinching members for the gripping member are moved toward each other while the pinching members engage the portion of the material sheet so as to pinch the portion of the material sheet between the pinching members and vertically displace the material sheet from the support member.

18 Claims, 9 Drawing Sheets

(56) References Cited

U.S. PATENT DOCUMENTS

| | | | | | |
|---|---|---|---|---|---|
| 5,248,177 | A * | 9/1993 | Jones | B65H 3/22 | 271/19 |
| 5,465,951 | A * | 11/1995 | Burt | B65H 1/04 | 271/167 |
| 5,653,431 | A | 8/1997 | Burt et al. | | |
| 5,806,845 | A * | 9/1998 | Burt | B65H 1/04 | 271/167 |
| 6,164,637 | A * | 12/2000 | Harari | B65H 3/02 | 271/19 |
| 6,739,261 | B2 * | 5/2004 | Ono | B65H 3/02 | 101/477 |
| 7,412,789 | B2 | 8/2008 | Jensen et al. | | |
| 7,607,280 | B2 * | 10/2009 | Dussault | B65B 41/04 | 493/309 |
| 7,744,078 | B2 * | 6/2010 | Gromadzki | B65H 3/38 | 271/14 |
| 8,875,942 | B2 | 11/2014 | Poliner | | |
| 2016/0309850 | A1 | 10/2016 | Jurkovic et al. | | |
| 2017/0087728 | A1 | 3/2017 | Prahlad et al. | | |

* cited by examiner

SYSTEM AND METHOD FOR PICKING SINGLE SHEET OF MATERIAL FOR FURTHER PROCESSING

CROSS-REFERENCE TO RELATED APPLICATIONS

This application claims priority from U.S. Provisional Patent Application No. 62/667,177, filed May 4, 2018, entitled "System for Picking Single Sheet of Material for Further Processing," the entire disclosure of which is incorporated herein by reference.

FIELD OF THE INVENTION

The present invention is directed toward an apparatus or system for picking up materials (e.g., fabric materials) and, in particular, an apparatus for picking up a sheet or panel of a fabric material from a substrate or from a stack of fabric sheets in a process for forming an article of apparel.

BACKGROUND OF THE INVENTION

Picking a single sheet of fabric material from a surface or from a stack of fabric sheets, followed by transporting and placing the single picked sheet of fabric at a designated location in a production process (e.g., a process for forming apparel or other textile material) is very difficult to automate due to the flexibility of the fabric and the ever-changing design of the pattern. This is further challenging when the sheet is very thin or has a very low basis weight, such as a single ply sheet of fabric.

While certain automated picking apparatuses are known for picking up a single sheet of fabric material, conventionally there is no known automated system that has demonstrated suitable flexibility and reliability necessary to eliminate the manual labor currently relied upon to pick a single ply sheet of fabric material from a stack of fabric sheets.

A system capable of reliably picking a single fabric sheet from a surface or from a plurality of sheets and transporting the single sheet to a designated location in a manufacturing process would enhance the manufacturing process by further automating this processing step and thus minimizing human labor otherwise associated with such processing.

BRIEF SUMMARY OF THE INVENTION

In certain embodiments, a method of automatically picking a single material sheet from a support member (e.g., a stack of vertically aligned material sheets or directly from a support surface) comprises aligning a gripping member above the support member, where the gripping member comprises a pair of spaced apart pinching members movably coupled with a main frame, and each pinching member includes an exposed gripping surface that is substantially planar and that faces an exposed surface of the material sheet. The gripping member is moved a first distance toward the exposed surface of the material sheet such that the gripping surfaces of the pinching members engage a portion of the material sheet. The pinching members for the gripping member are moved toward each other while the pinching members engage the portion of the material sheet so as to pinch the portion of the material sheet between the pinching members. In addition, the gripping member is moved away from the support member while the pinching members for the gripping member pinch the portion of the material sheet so as to vertically displace the material sheet from the support member.

In another embodiment, an automated system is provided for picking a single material sheet from a support member. The system comprises a gripping member comprising a main frame, and a pair of finger members movably coupled to the main frame, where each finger member comprises a carriage member that is movable along a rail of the finger member, and a pinching member coupled with the carriage member, where the pinching member includes an exposed lower gripping surface that is substantially planar. The pinching member for each finger member is movable, via the corresponding carriage member, toward the pinching member of the other finger member so as to facilitate engaging contact between facing sides of the pinching members during system operation. The system can further include a controller that controls movement of the pinching members of the gripping member toward each other during system operation.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION OF THE INVENTION

Figure 1A:
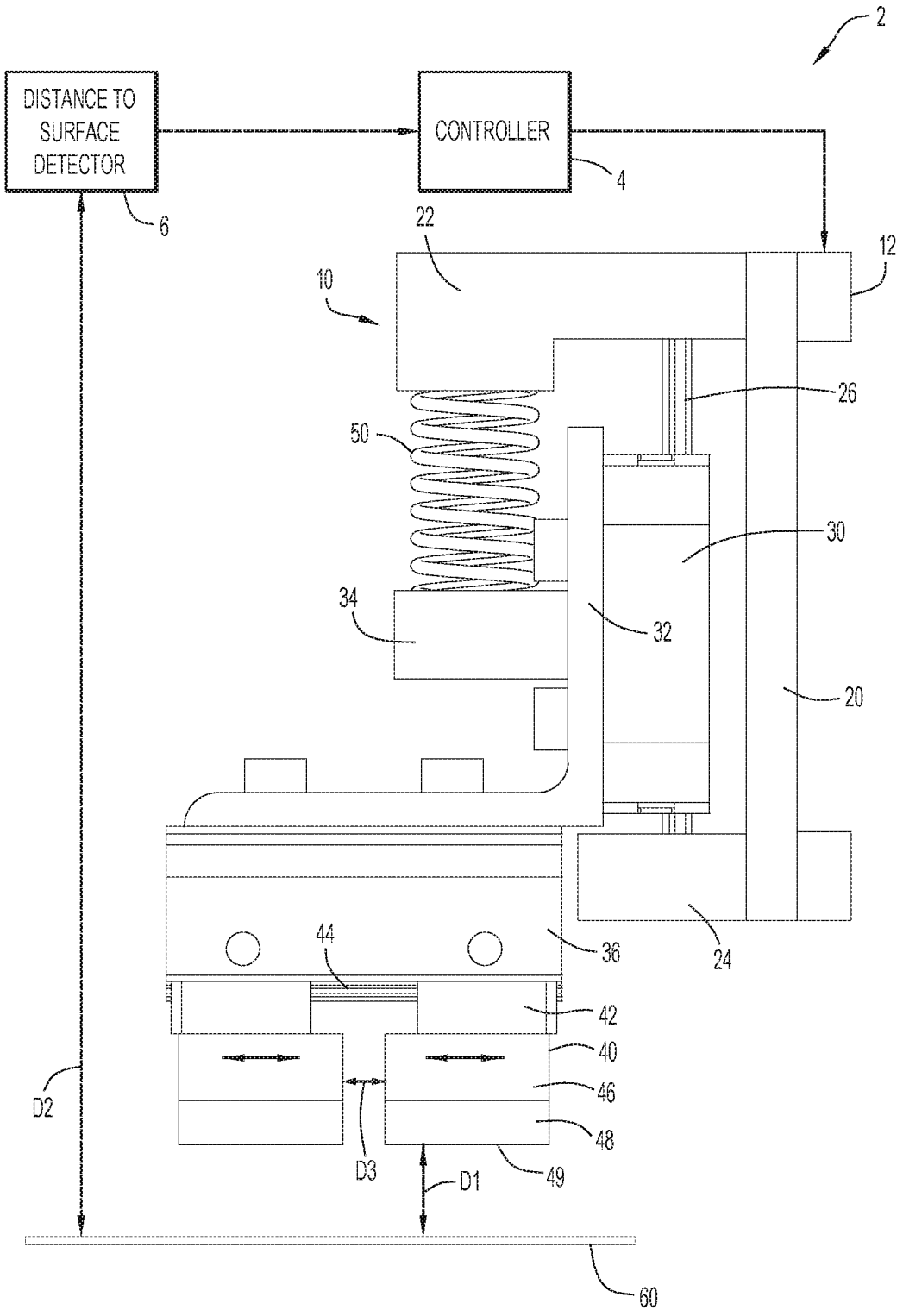
FIGS. 1A-1C depict views of a gripping member for an automated picking system, the gripping member being configured to pick a single fabric sheet from a vertical stack of fabric sheets.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

In accordance with example embodiments of the invention, a system for picking a single panel or sheet of material (such as a sheet of fabric material) is described herein, where the system is automated and utilizes at least one gripping member or gripper (in certain embodiments, a plurality of gripping members or grippers) to pick a single material sheet (e.g., a fabric sheet) from a support member (e.g., picking a single material sheet directly from a support surface or picking a single uppermost material sheet from a plurality of vertically stacked sheets) in order to facilitate transport and processing of the single material sheet at another processing location. For example, the system can be configured to pick a very thin, single sheet of fabric from a substrate surface (e.g., a relatively flat surface of a work table or other structure) or from a plurality of stacked fabric sheets utilizing one or more grippers. The term "pick" or "picking", as used herein with regard to picking a material sheet, refers to utilizing one or more system components to physically engage a material sheet, vertically displace (e.g., from a surface or from a vertical stack of material sheets) and/or move the material sheet from its location at rest to another location in order to facilitate processing of the material sheet (e.g., during a process of manufacturing an article of apparel that includes the material sheet).

The material sheet that is processed by the picking system can be formed of any type of textile or other material that is sufficiently flexible such that a portion of the material sheet can be folded or pinched between two finger portions of a gripper to facilitate picking (i.e., lifting and removing) of a single material sheet from a substrate surface or from a plurality of vertically stacked material sheets. In some embodiments, the material sheet comprises a fabric sheet. Some examples of fabric sheets that can be picked and processed by the system include, without limitation, textile materials that are woven, nonwoven, knitted, braided, embroidered, etc. Other types of material sheets that can be picked and processed in accordance with the invention include, without limitation, leather sheets, mesh sheets (e.g., fabric mesh or any other type of mesh material formed as a sheet), and vinyl sheets.

In certain embodiments, the system is configured to process fabric materials in which a single sheet comprising a single ply fabric is picked (i.e., lifted and removed) from a support surface (e.g., from the support surface of a work table or other structural surface) or from a stack of other single ply fabric sheets (and/or other fabric sheets). A single ply fabric sheet refers to a sheet formed of a fabric material comprising single threads woven together (e.g., a single ply cotton fabric sheet). In addition, the system can further be configured to also pick single sheets from a plurality of stacked sheets that are thicker or have a greater basis weight than a single ply fabric sheet, such as any other type of textile sheet that may be woven, knitted, nonwoven, braided, embroidered, etc.

Figure 1B:
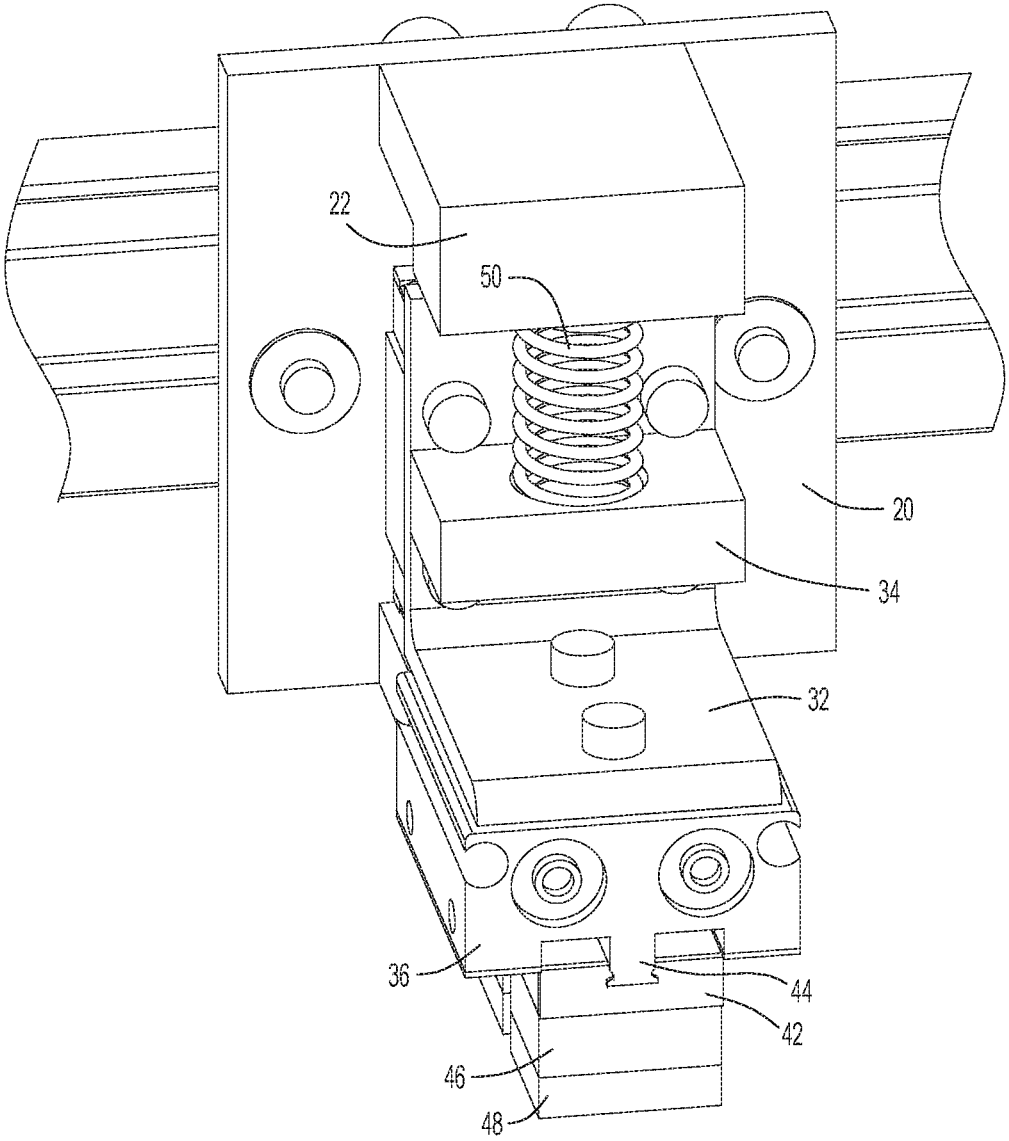
Figure 1C:
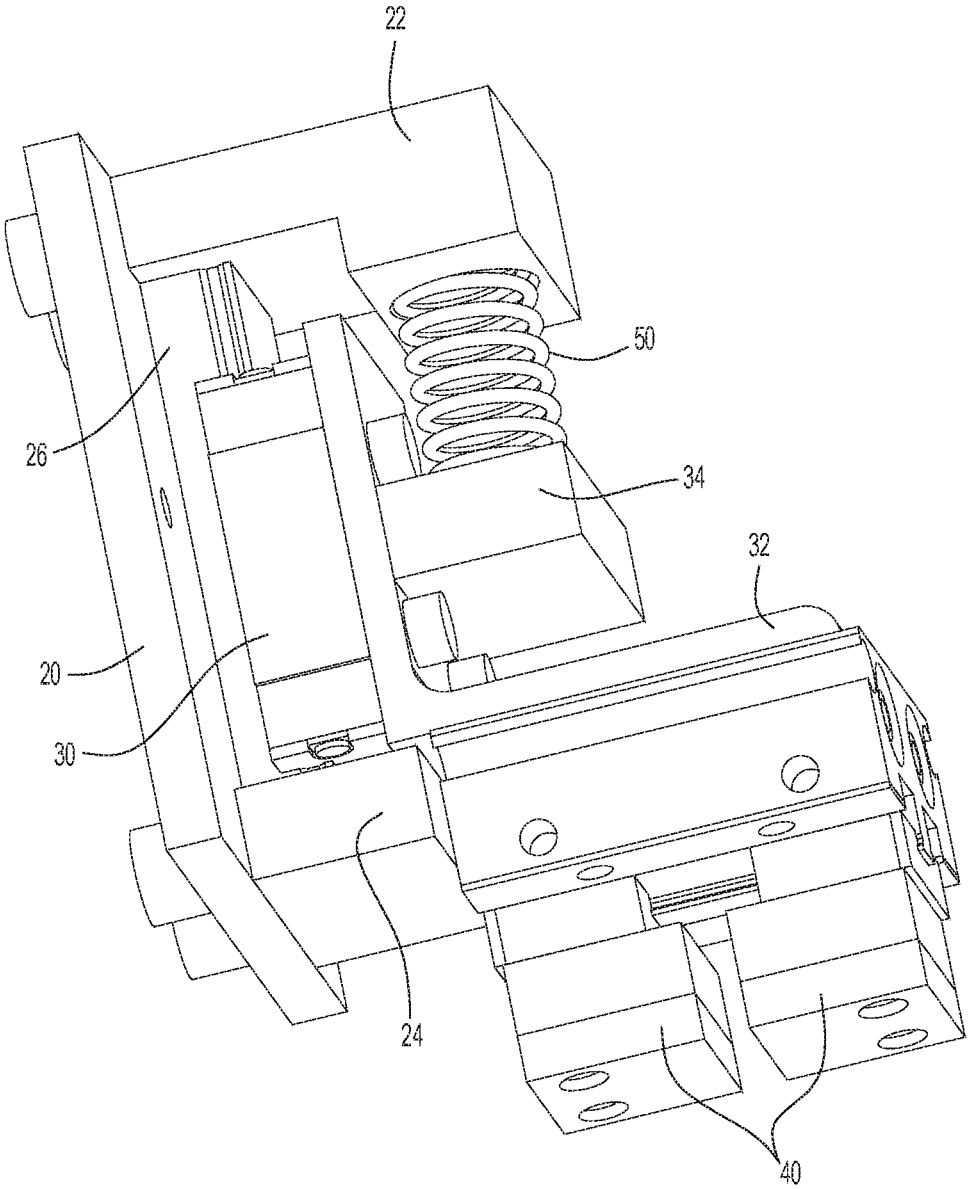
Figure 2A:
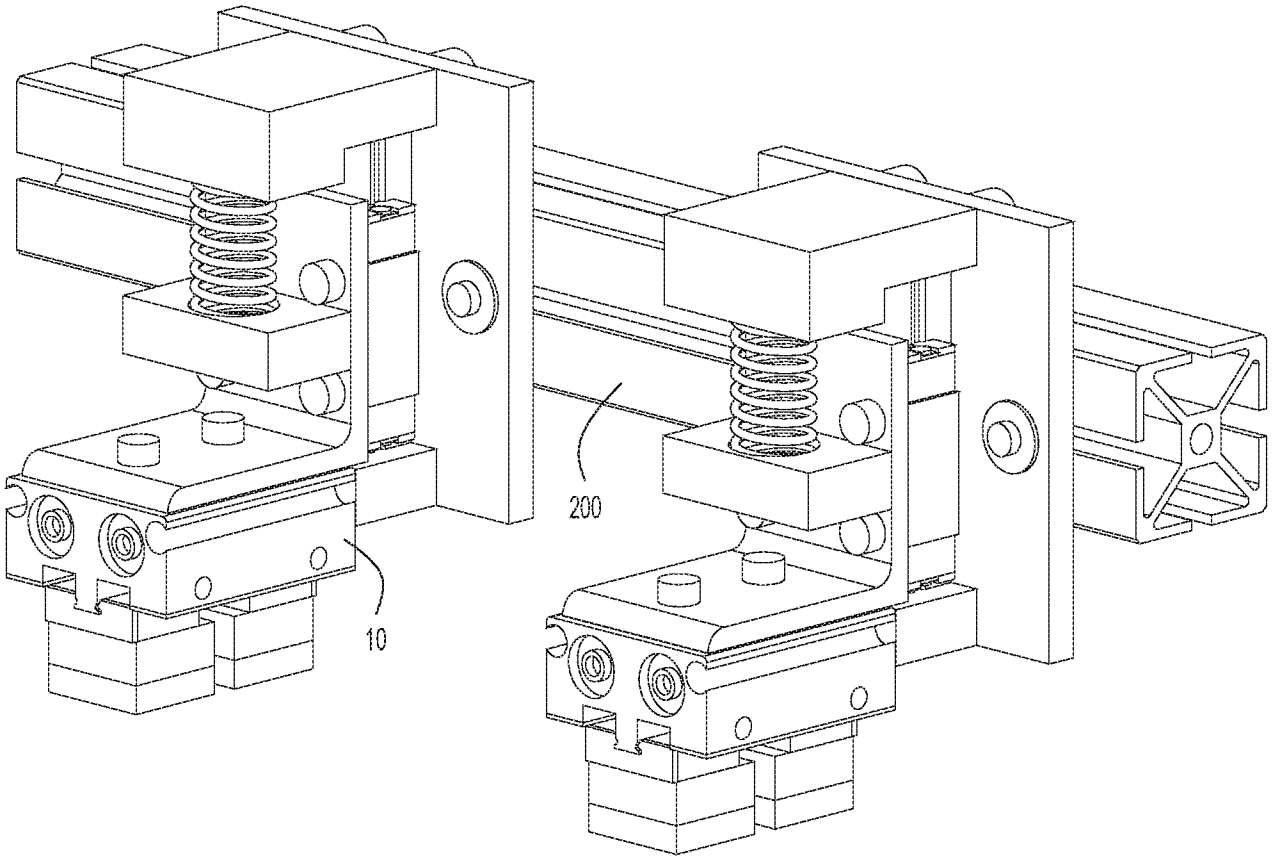
FIGS. 2A and 2B depict a plurality of gripping members secured to a guide element of the automated picking system.
Figure 2B:
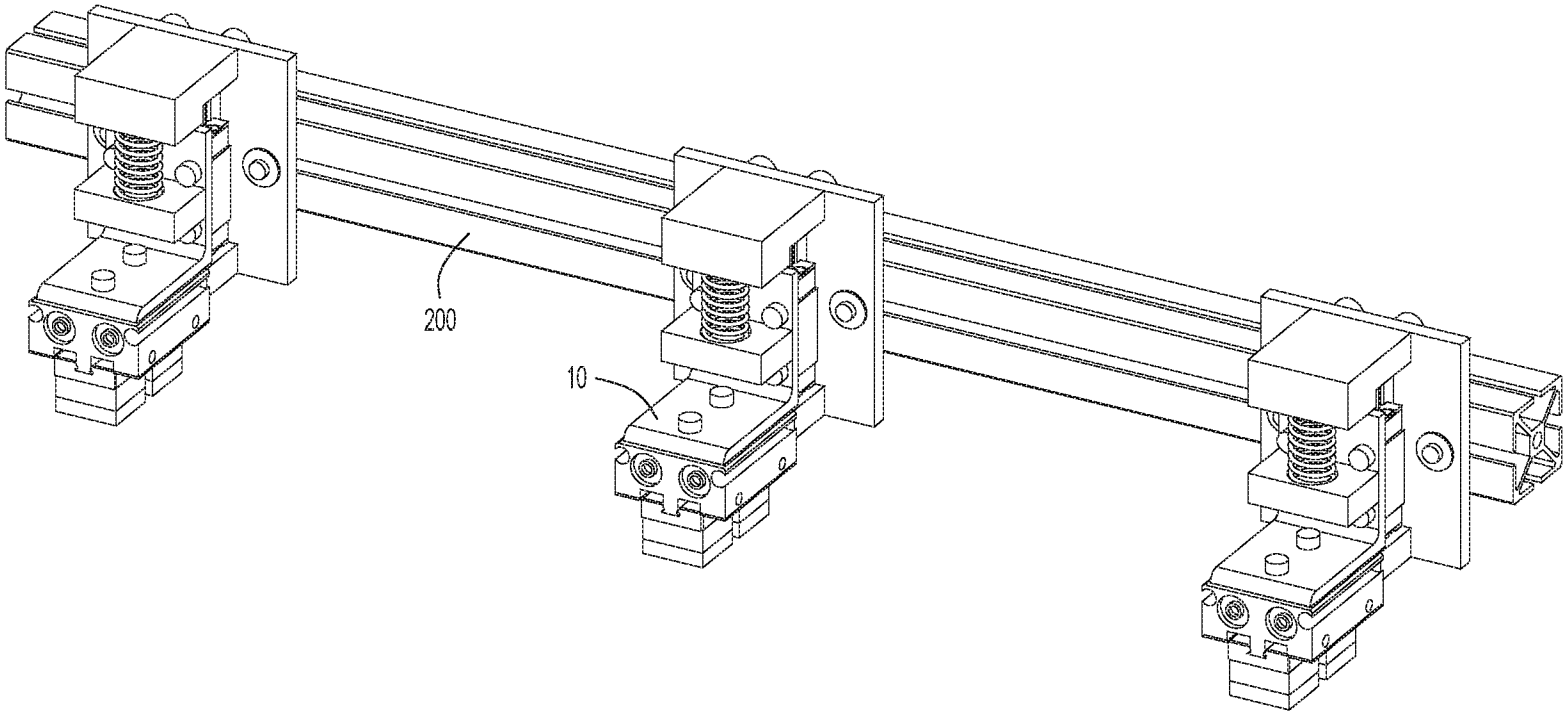
Figure 3A:
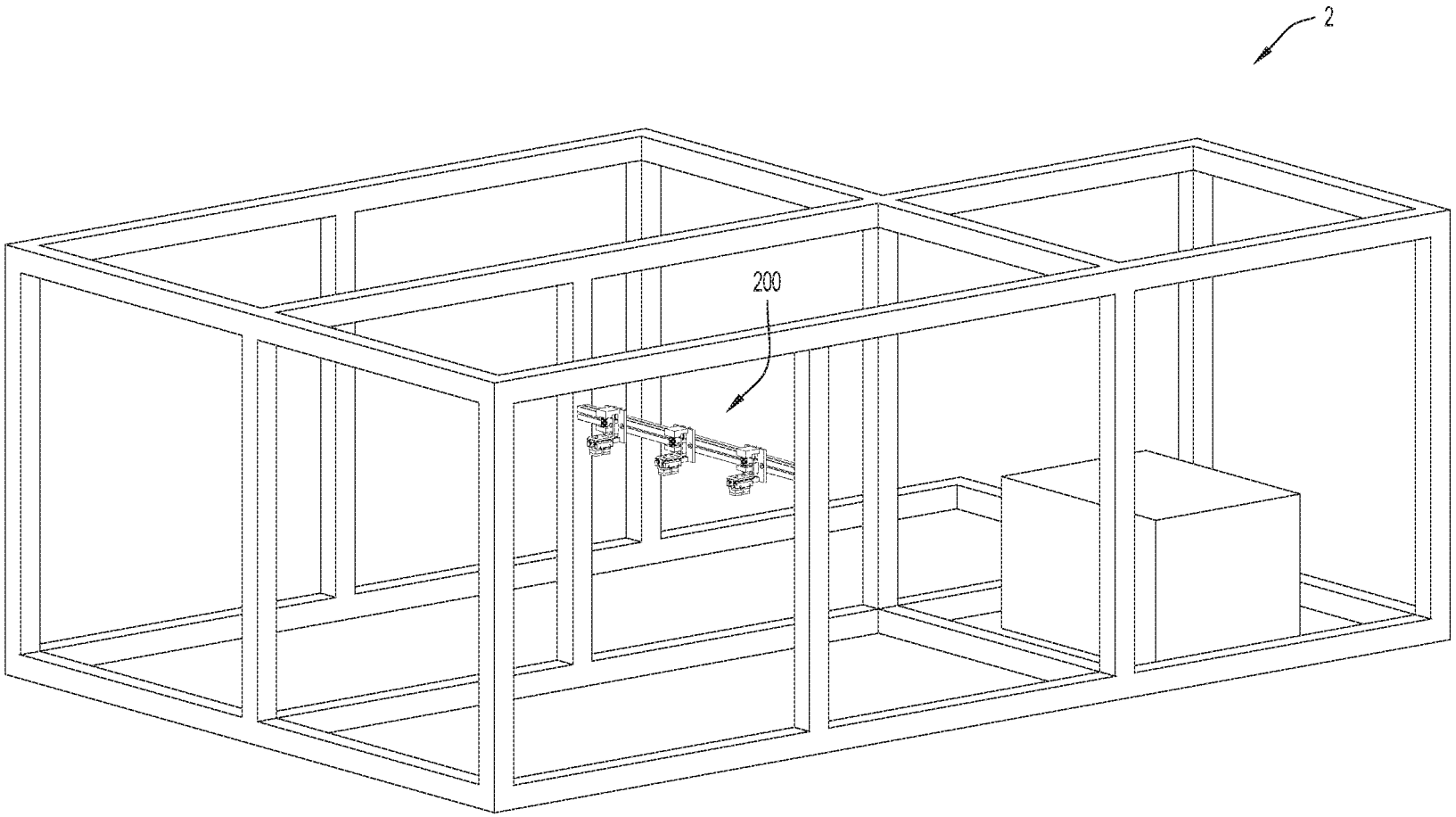
FIGS. 3A and 3B depict views of an example embodiment of an automated picking system that includes gripping members.
Figure 3B:
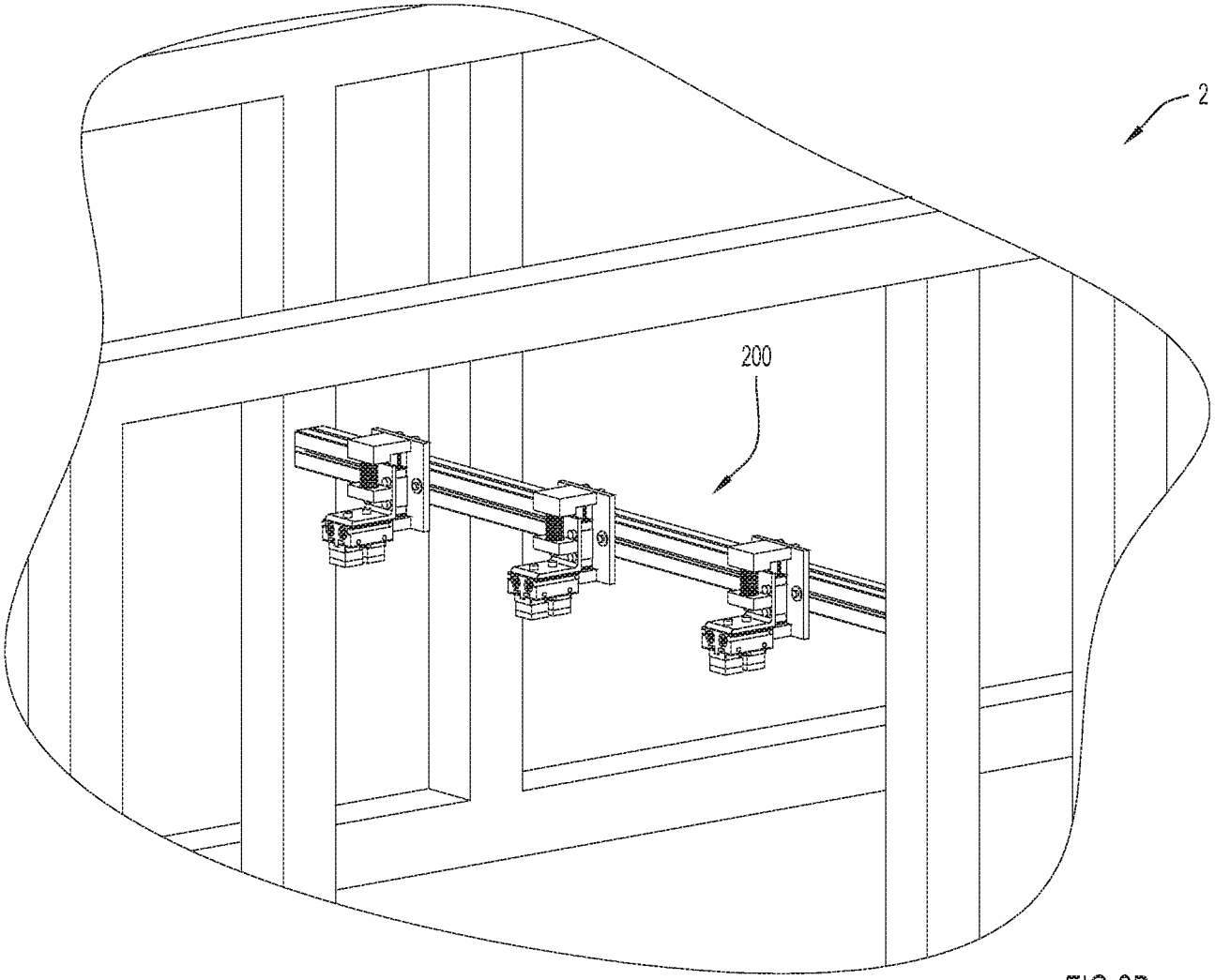

An example embodiment of a gripping member (also referred to herein as a gripper) integrated within an automated picking system is depicted in FIGS. 1A-1C. In particular, the system 2 includes a controller 4 that controls automated operations of the system, a detector 6 that determines a distance between gripping surfaces of the gripping member or gripper and a surface of the material sheet as described herein, and a gripping member or gripper 10. The gripper 10 includes a main member or main frame 20 that secures, via fastening or securing elements 12 (e.g., bolts or other suitable fasteners), to a suitable guide element (e.g., guide element 200 as shown in FIGS. 2A and 2B as described herein). The guide element (e.g., element 200) can comprise a movable support beam or rail that is connected within a frame construction for the system (e.g., as depicted in the embodiment of FIGS. 3A and 3B and as described in further detail herein).

Unless specifically noted otherwise herein, portions or components of each gripper 10, guide element and other portions of the frame forming the automated picking system can be constructed of any suitable metals (e.g., steel, aluminum, etc.) and/or other suitably rigid materials that facilitate adequate operation of the system.

As described herein, the controller 4 is configured to control movements in two or more dimensions (e.g., three dimensional movement) of the guide element, which in turn facilitates corresponding movement of the gripper 10, between station locations and/or to different areas of a single station location, where a station location can include a vertical stack of single material sheets to be individually transported and processed by the system 2.

The main frame 20 of the gripper 10 comprises a generally rectangular block or plate and includes an upper arm member 22 at a first or upper end of the main frame and a lower arm member 24 at a second or lower end of the main frame. Each of the upper and lower arm members 22, 24 extends transversely from and at the first/upper and second/lower ends of the main frame 20, where the upper arm member 22 extends in the same direction but further in distance from the main frame 20 in relation to the lower arm member 24. The main frame 20 further includes a track or rail 26 that extends between the first/upper and second/lower ends of the main frame 20. In particular, the track or rail 26 extends between the upper and lower arm members 22, 24, and a movable carriage member 30 that engages with the rail 26 (e.g., via a channel disposed along a surface of the carriage member) to facilitate vertical (up and down) movements of the carriage member 30 along the rail 26 in relation to the main frame 20 during operation of the gripper 10.

Secured to the carriage member 30 is a generally L-shaped support plate 32, where a vertically extending portion of the L-shaped plate 32 is secured to the carriage member 30 while a horizontally extending portion of the L-shaped plate 32 extends transversely away from the carriage member 30. A biasing member support block 34 is connected to and extends transversely from the vertically extending portion of the L-shaped plate 32 at a location that is proximate a midpoint of the length of the vertically extending portion. The support block 34 is further suitably dimensioned so as to be vertically aligned with and located a distance below a terminal end portion of the upper arm member 22. A finger support block 36 is connected with and extends below the horizontally extending portion of the L-shaped plate 32. As described in further detail herein, the finger support block 36 supports and facilitates movement of finger members used to pick individual or single material sheets from a support surface or from a vertical stack of material sheets.

A force dampening or force modulating mechanism can be provided to precisely control an amount of force applied by components of the gripper to a material sheet to be picked by the system. In the example embodiment depicted in the figures, a resilient member is provided to modulate or precisely control the force applied by the gripper 10 to a material sheet to be picked. In other embodiments, any suitable structure can be utilized instead of a resilient member to control the force applied by the gripper to the material sheet. For example an applied force by the gripper can be monitored and controlled by monitoring and controlling a downward movement of the gripper toward the material sheet surface, providing one or more strain gauge sensors to measure force and/or pressure applied by the gripper to the material sheet surface and utilizing such measured force and/or measured pressure to adjust the force applied by the gripper to the material sheet, etc.

Referring to the figures, a resilient member, such as a coil spring 50 (as depicted in the figures), is provided so as to extend between the support block 34 and the terminal end of the upper arm member 22, where an upper end of the spring 50 engages and/or connects with the terminal end portion of the upper arm member 22 and a lower end of the spring 50 engages and/or connects with the support block 34. The spring 50 biases the support block 34, L-shaped plate 32 and carriage member 30 vertically downward away from the upper arm member 22 and toward the lower arm member 24 of the main frame 20. As depicted in FIG. 1A, when the support block 34 is at rest (i.e., the support block 34 is at its furthest position away from the upper arm member 22), the spring biasing force pushes the carriage member 30 to a lower end of the rail 26 (e.g., the carriage member 30 and/or a portion of the L-shaped plate 32 can be biased by the spring 50 so as to engage the lower arm member 24 of the main frame 20).

A pair of gripping finger members or fingers 40 are movably connected with and at a lower end of the finger support block 36. When at rest (i.e., prior to being moved toward each other in a picking operation), the fingers 40 are separated a set distance from each other, where each finger 40 extends in a direction across the support block 36 in a direction that is transverse the lengthwise dimension of the horizontally extending portion of the L-shaped plate 32. The support block 36 includes a track or rail 44 extending along its lower surface in a direction that corresponds with the lengthwise dimension of the horizontally extending portion of the L-shaped plate 32. The rail 44 of the support block 36 further extends in a direction that is transverse (e.g., perpendicular) relative to the rail 26 of the main frame 20. Each finger 40 includes a finger moving carriage member 42 that engages with the rail 44 (e.g., via a channel disposed along a surface of the carriage member 42 as shown in the view of FIG. 1B) to facilitate movement of the carriage member 42 along the rail 44 and thus movement of the finger 40 in relation to the support block 36. Thus, the carriage members 42 can move along the rail 44 toward and away from each other during system operation (as shown by the double headed arrows in FIG. 1A indicating directions of movement for each finger 40). As is further evident from the figures, each finger member 40 is movable along its corresponding rail 44 in a direction that is transverse (e.g., perpendicular) relative to movement of the carriage member 30 along the rail 26 of the main frame 20. More particularly, the finger members 40 are configured to move relatively horizontally toward each other along rail 44, while the carriage member 30 is configured to move relatively vertically along rail 26 during operation.

Connected to a lower surface of each carriage member 42 is a finger block 46 that is aligned with the carriage member 42 such that the lengthwise dimension of the block 46 corresponds with the lengthwise dimension of the carriage member 42 (where such lengthwise dimension is transverse the lengthwise dimension of the horizontally extending portion of the L-shaped plate 32). The width dimension of each finger block 46 is greater than the width dimension of its corresponding carriage member 42 such that a portion of each finger block extends beyond the carriage member in a direction toward the other finger block. As depicted in FIG. 1A, the facing surfaces of the finger blocks 46 are separated from each other a distance D3 prior to any movement of the finger members 40 toward each other along the rail 44. Connected to a lower surface of each finger block 46 is a pinching member or pincher 48. Each pincher 48 has a length and width dimension that corresponds with the finger block 46 to which it is connected such that the facing surfaces of the pinchers 48 are also separated from each other the same distance D3 prior to any movement (i.e., during a picking operation as described herein) of the finger members 40 toward each other along the rail 44.

Each pinching member 48 is formed of a material that provides a sufficiently high coefficient of friction along its exposed surfaces and, in particular, along its lower surface that is configured to engage and pick a material sheet (e.g., a single ply fabric sheet that is disposed on a support surface or located as the top most sheet in a vertical stack of material sheets provided on the support surface). In particular, the material used to form the pinching members 48 and/or a lower surface of the pinching members can be selected so as to impart a suitable or sufficient texturized surface or surface roughness to the pinching member lower surfaces, provide a sufficient amount of tackiness to the pinching member lower surfaces and/or provide a sufficient deformability or hardness (e.g., as measured on a suitable durometer scale, such as a Shore A hardness measurement) to the pinching members which will effectively enhance the pinching capabilities of the pinching members and the operation of picking a material sheet.

In example embodiments, each pincher 48 can be formed of a rubber or elastomeric polymer material, where the contacting surface of the material provides a high coefficient of friction when applied against other materials (including a fabric or other material sheet to be picked by the system). For example, the material forming a pincher 48 can comprise polyurethane or any other suitable elastomeric material having a suitable hardness (e.g., a polyurethane or other polymer material having a Shore A hardness durometer value from about 30 to about 80, such as a Shore A hardness durometer value of about 50, about 60, or about 70). In other example embodiments, each pincher 8 can comprise a metal material including a gripping tape secured to the metal material and that defines the pincher lower surface so as to provide a sufficient texturized/roughened surface for gripping certain types of material sheets (e.g., thick woven material sheets).

In certain embodiments, the lower, material engaging surface 49 of each pincher 48 is substantially flat or planar (i.e., having little or no curvature) so as to maximize the area of contact between a frictional, gripping surface 49 and a material sheet to be picked. Each pincher 48 can also be suitably dimensioned such that its gripping surface 49 (e.g., a substantially flat or planar surface) has a suitable gripping surface area for contacting a sheet during the picking process. For example, the gripping surface 49 can have a surface area of at least about 100 $mm^2$, such as a surface area of at least about 200 $mm^2$, or a surface area of at least about 300 $mm^2$ (with a surface length of at least about 20 mm and a surface width of at least about 15 mm).

Figure 1D:
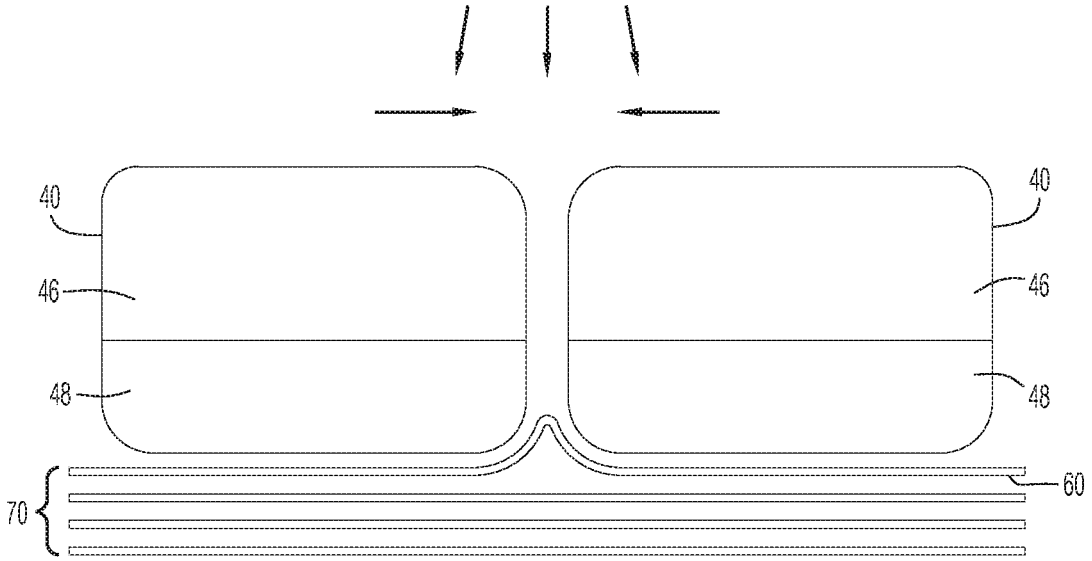
FIGS. 1D and 1E depict a portion of the gripping member of FIGS. 1A-1C in a picking operation.
Figure 1E:
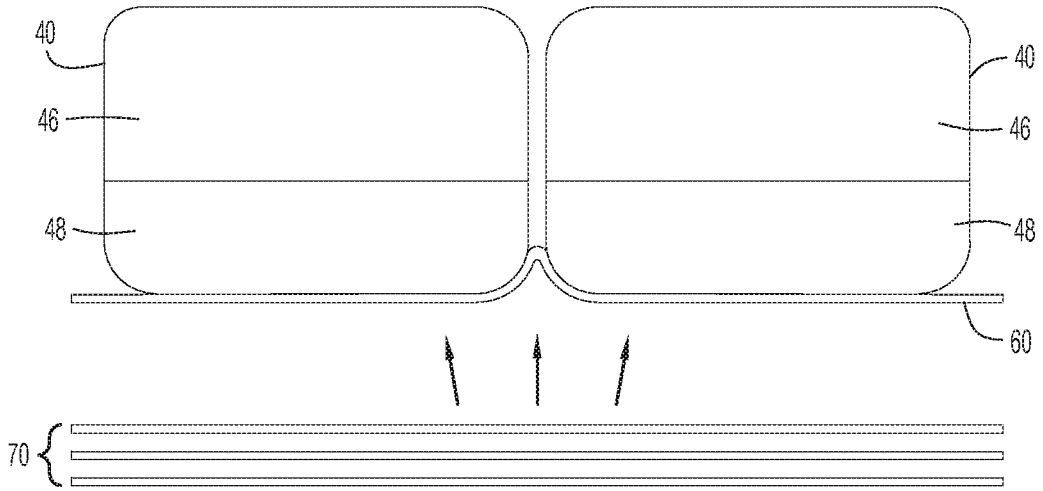

Movement of the finger members 40 toward each other during system operation can be achieved utilizing any suitable type of force applied to each carriage member 42 that facilitates sliding movement of the carriage members 42 along the rail 44 of the support block 36 such that the finger support blocks 46 and/or pinchers 48 engage with each other (as shown in FIGS. 1D and 1E). In example embodiments, the system 2 is provided with suitable conduits, wiring, tubing and/or other related equipment to apply an automated force (e.g., pneumatic force, hydraulic force, electrical force, etc.) controlled by the controller 4 that moves the carriage members 42 along the rail toward each other causing the support blocks 46 and/or pinchers 48 to contact each other at their facing surfaces during the picking process (i.e., during picking of a material sheet to facilitate transport of the material sheet to another station in the system 2). For example, a pneumatic cylinder can be coupled with each carriage member 42 that is controlled by the controller 4 to facilitate movement of the carriage members toward each other by the pneumatic cylinders during system operation.

Movement of the finger members 40 away from each other can also be achieved via similar automated forces. Alternatively, one or more biasing members, such as one or more coil springs (not shown), can also be provided and suitably dimensioned and aligned to bias the finger members 40 away from each other, where the automated force applied to the finger members 40 overcomes such biasing force to move the finger members 40 toward each other until finger support blocks 46 and/or pinchers 48 engage with each other (and subsequent removal of the automated force then results in the support blocks 46 and pinchers 48 being biased by the spring(s) away from each other).

The detector 6 is configured to measure a distance between the detector 6 (e.g., a lower surface of the detector) and an upper surface of a sheet in a vertical stack of sheets, such as the distance D2 between detector 6 and sheet 60 as shown in FIG. 1A. For example, the detector can comprise a laser distance guider or laser distance sensor to provide a precise measurement of the distance at any given time between the detector and a surface directly below the detector, such as the upper surface of a material sheet. Based upon a preset or predetermined alignment between the detector 6 and a gripper 10, the measured distance D2 can be used to determine a distance between the lower surface 49 of the pincher 48 and the upper surface of the material sheet 60, such as distance D1 as shown in FIG. 1A.

The controller 4 comprises any commercially available or other suitable processor (e.g., a controller including suitable programmable control logic and suitable memory to facilitate programming of automated control operations associated with the components of the picking system) that is hardwired and/or wirelessly coupled to the detector 6 so as to receive measured distance information (e.g., measured distance D2) from the detector to facilitate a determination of the distance between the lower surfaces of the pinchers 48 to an upper surface of a material sheet (e.g., distance D1). While the controller 4 and detector 6 are schematically depicted as separate components in FIG. 1A, in certain embodiments these two components can be combined or integrated as a single unit. The controller 4 is further coupled (e.g., wirelessly and/or hardwired) to other components (e.g., motorized support structure that moves guide element 200) that facilitate movements in as many as six degrees of freedom, including upward and downward movements (i.e., movements along directions corresponding with distances D2 and D1 as shown in FIG. 1A) and rotational movements of the gripper 10 so as to facilitate engagement of the pinchers 48 with a material sheet (e.g., sheet 60 as depicted in FIGS. 1D and 1E). For example, the controller 4 can control movement of the gripper 10 downward toward a stack of material sheets at least the distance D2 (i.e., at least the distance between the engaging surfaces 49 of the pinchers 48 and the facing upper surface of the sheet 60) and, in certain embodiments, downward movement of the gripper 10 by the controller 4 is slightly farther than such distance D2. This facilitates a suitable force and pressure applied by the pinchers 48 to the material sheet 60 as well as a suitable frictional surface contact between the gripper surfaces 49 and the upper surface of the sheet 60. As described further herein, the spring 50 of the gripper 10 dampens the amount of force and pressure applied by the gripper 10 to the material sheet 60 as it is moved downward onto the sheet 60, thus allowing for small or fine tuning/granular adjustments to the applied force by the gripper 10 during system operation.

The controller 4 also controls movement of the finger members 40 toward and away from each other by controlling the amount of automated force applied to the finger members, where such movements by the finger members 40 effects a pinching of the material of a material sheet between the pinchers 48 as the pinchers are brought together (e.g., as depicted in FIGS. 1D and 1E).

The ability of the gripper 10 to frictionally engage the surface of a single material sheet (e.g., a single ply fabric sheet) that is disposed on a support surface or at the top of a vertical stack of material sheets, pinch a portion of the sheet between the pinchers 48, and vertically lift the single material sheet from the support surface or from the stack while leaving the remaining sheets disposed and substantially undisturbed (i.e., not moved) in the vertical stack can be based upon a number of factors or parameters that can be adjusted based upon particular applications during system operation. Some non-limiting examples of adjustable factors that can influence or enhance picking of a material sheet during system operation include the material or materials used to form the pinchers 48 (e.g., compressibility and/or hardness of the material(s), and surface roughness and/or tackiness as previously noted herein), surface area of the gripping surface 49, spacing D3 between the facing surfaces of each pair of pinchers 48, and the amount of force and/or pressure applied by the pinchers 48 to the exposed, upper surface of the material sheet to be picked by the system. Adjustment of these factors can be based, e.g., upon the type of material forming the sheet to be picked. For example, when picking individual sheets of single ply fabric (i.e., a very thin fabric sheet having a very low basis weight) from a support surface or from a vertical stack of fabric sheets, the amount of force/pressure to be applied to the surface of a fabric sheet may need to be finely tuned to facilitate picking and vertically displacing the fabric sheet, especially when picking the sheet from a stack of sheets so as to leave the remaining sheets undisturbed (i.e., not displacing the other fabric sheets in the stack). In other embodiments in which fabric or other material sheets having a greater basis weight are being picked, the force/pressure applied to the material sheet can be adjusted accordingly to enhance the picking operation.

The amount of force and/or pressure applied by the pinchers 48 to a material sheet to be picked by the system is further adjustable/controllable by controlling the distance at which the gripper 10 is moved downward toward the material sheet to be picked, which is at least the distance between the gripping surfaces 49 and the sheet surface (i.e., a distance of D2 or greater). The configuration of the spring 50 for the gripper 10 can also be configured to have a suitable spring constant so as to provide a desired damping effect that controls the amount of force and/or pressure applied to the material surface by the pinchers 48 based upon a selected distance at which the grippers are moved downward onto the material sheet surface. Thus, the spring constant can be adjusted in combination with the distance of downward movement of the gripper 10 so as to fine tune or provide granular adjustment in the amount of resultant force and/or pressure applied by the pinchers 48 at the material sheet surface. In example embodiments (e.g., when picking single ply fabric sheets), a spring constant for a spring 50 used with a gripper 10 can vary from about 0.50 N/mm to about 0.90 N/mm (e.g., about 0.75 N/mm).

The spacing or gap between the pinchers 48 (e.g., distance D3 as shown in FIG. 1A) can be adjusted to influence or enhance the picking operation for a particular application. In example embodiments in which an individual, single ply fabric sheets are picked from a vertical stack of fabric sheets, the distance D3 between the pinchers 48 can be adjusted so as to be no greater than 0.14 inch (about 3.56 mm), preferably from about 0.10 inch (about 2.54 mm) to about 0.13 inch (about 3.30 mm), such as about 0.125 inch (about 3.175 mm). The spacing distance between the pinchers (distance D3) can be adjusted based upon the type of fabric or other material sheet to be picked, where certain materials may require a greater or smaller distance between the pinchers to enhance the ability of the pinchers to grab or pinch a portion of the material sheet between the pinchers. For example, a gap distance D3 between the pinchers can be selected as a function of the basis weight of the material sheet to be picked.

In addition, the timing of when the pinchers 48 are moved toward each other to pinch the material sheet 60 can be controlled with downward and/or upward movements of the gripper 10 so as to enhance the picking operation of the gripper 10. For example, the system 2 can be designed so that the controller 4 effects movement of the pinchers 48 together only after downward movement of the gripper 10 has been completed (i.e., when the gripper 10 is at its lowest position in relation to the material sheet to be picked). Alternatively, the pinchers 48 can be moved together at a point when the gripper 10 is still moving downward (i.e., prior to the gripper 10 having achieved its lowest position). For example, in a scenario in which downward movement of the gripper 10 toward a material sheet surface is implemented to a distance that is slightly greater or slightly exceeds the distance D2 between gripping surfaces 49 and the upper surface of the material sheet 60, the pinchers 48 can be controlled so as to move toward and engage with each other when the gripping surfaces 49 have been moved the distance D2 (or at a distance that is slightly smaller than D2) so as to provide a combined or simultaneous downward force/pressure as well as a pinching force upon the material sheet 60. In a further embodiment, the gripper 10 can be moved to its final/lowermost downward position in relation to the material sheet 60, followed by combined movement of the pinchers 48 together combined with upward movement of the gripper 10 so as to facilitate a near simultaneous pinching of a portion of the material sheet 60 between the pinchers 48 while vertically displacing the sheet 60 upward with upward movement of the gripper 10.

The combined vertical movements of the gripper 10 with pinching movements of the pinchers 48 toward each other (based upon any of the previously described parameters which enhance the picking operation) effect a capture or pinching of a portion of the material sheet 60 between the pair of pinchers 48, as depicted in FIG. 1D, where the gripper can be moved upward as depicted in FIG. 1E to vertically displace the material sheet 60 from a stack 70 of material sheets (where the sheets in the stack 70 remain in place, i.e., the sheets are not moved/not disturbed by the picking of material sheet 60 from the stack 70).

The system 2 can include any number of grippers 10 that may secure to a guide element of the system that facilitates movement of each gripper to a location so as to be aligned with a single material sheet on a support surface or a material sheet disposed on a stack of material sheets to be picked. Referring to FIGS. 2A and 2B, the system 2 includes a guide element 200 to which any number of grippers 10 (two grippers 10 as shown in FIG. 2A, three grippers 10 as shown in FIG. 2B) can be secured (e.g., via bolts or other securing elements 12). The number of grippers (e.g., one, two, three or more) provided along a guide element can be implemented based upon the size of material sheets to be picked and processed for a particular application. For example, in certain embodiments, material sheets to be picked and processed may have certain surface area dimensions that may require at least two, or possibly three or more grippers to pinch and hold portions of a single material sheet as it is picked and moved to another processing station in the system. Utilizing a plurality of grippers can ensure that a single material sheet is uniformly picked up and moved directly from a support surface or from a vertical stack of material sheets by gripping the material sheet at opposing ends of the sheet and further minimizing any droop or sagging at one or more intermediate locations of the sheet. The alignment of any two or more grippers can be configured so as to facilitate suitable picking of a material sheet on a vertical stack of sheets without substantially disturbing other sheets within the stack from which the individual sheet is being picked. In the embodiments depicted in FIGS. 2A and 2B, the plurality of grippers 10 are aligned in a linear manner in relation to each other and are further suitably spaced from each other to facilitate even and uniform picking of a single material sheet from a plurality of vertically stacked sheets. In other embodiments, and depending upon certain applications, a single gripper can be utilized to effectively pick a single material sheet directly from a support surface or from a vertical stack of sheets.

The guide element 200 can also be secured within the system 2 so as to be movable (e.g., via the controller 4) between different stations of the system and/or in different alignment positions with regard to a single material sheet disposed on a support surface or one or more sheets from a vertical stack of material sheets to be picked at a station of the system. FIGS. 3A and 3B depict an example embodiment of a system 2 including a plurality of structural beams and/or guide rails, with other suitable structure (e.g., automated motors and pulleys controlled by one or more controllers) that facilitate three dimensional spatial movement of the grippers (e.g., along an X dimension, Y dimension and/or Z dimension) within the system.

Figure 4:
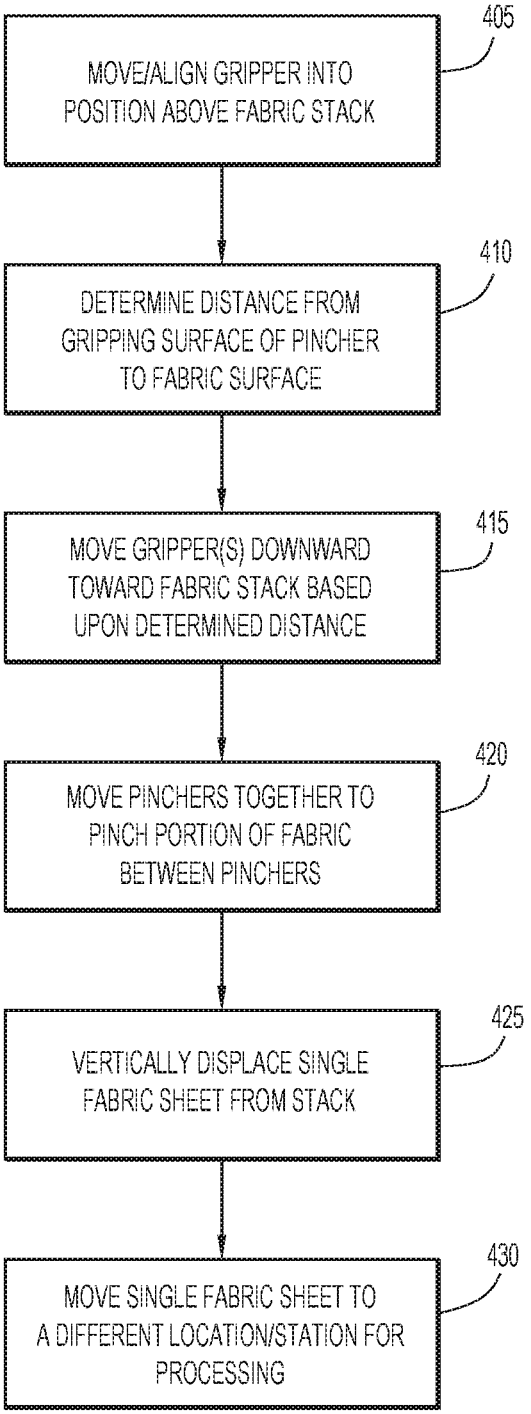
FIG. 4 is a flowchart describing method steps in an automated picking process utilizing an automated picking system in an example embodiment of the invention.

System operation is now described with reference to the flowchart of FIG. 4 as well as the embodiments depicted in FIGS. 1-3 and in relation to a stack of fabric sheets (e.g., single ply fabric sheets). At 405, the gripper 10 is moved into position over a fabric sheet stack 70. Such movement can include movement in number of linear and/or rotational dimensions that facilitate alignment of the gripper 10 over the fabric sheet stack 70. In particular, the controller 4 controls movement (e.g., by moving guide element 200) of the gripper in any number of directions within the system 2 as necessary to appropriately align the gripper 10 for performing a picking operation.

At 410, a distance D1 is determined between the gripping surface 49 of a pincher 48 and an upper, facing surface of a fabric sheet 60 to be picked from the stack 70. This can be achieved, e.g., by measuring a distance D2 between the detector 6 and the fabric sheet surface, where the controller 4 utilizes this measurement to determine the distance D1. At 415, the grippers 10 (e.g., two or more grippers as shown in the embodiments of FIGS. 2A and 2B) are moved (e.g., by automated movement of the guide element 200, as controlled by the controller 4) a sufficient distance toward the surface of the fabric sheet 60 (e.g., the distance D1 or slightly greater than the distance D1) that provides a desired or predetermined amount of force and/or pressure to the fabric sheet 60. As previously noted, the spring 50 provides a damping effect that modulates the downward force/pressure applied by the grippers 10 to the fabric sheet 60 to be picked so as to achieve a fine tuning or granular control on the amount of force/pressure applied. In particular, when the gripping surfaces 49 of the pinchers 48 make contact with the surface of the fabric sheet 60, any continued downward movement of a gripper 10 will apply a force that offsets the biasing force applied by the spring 50. This in turn causes the carriage member 30 to move slightly upward along the rail 26 of the main frame 20 resulting in a damping effect on the force applied by downward movement of the gripper 10 toward the fabric sheet surface (i.e., the spring 50 modulates or finely controls the resultant force and/or pressure applied by the pinchers 48 to the fabric sheet surface). Thus, control of the downward travel distance of the gripper 10 (based upon the determined distance D1 between gripping surfaces 49 of the pinchers 49 and the surface of the fabric sheet 60 to be picked) and the configuration of the spring 50 (e.g., providing a spring having a suitable spring constant) effects a precise control on the amount of force/pressure applied by the pinchers 48 to the fabric sheet 60.

After the grippers 10 have been suitably moved into position with the fabric sheet 60 (previous step 415), at 420, the pinchers 48 of the fingers 40 are automatically moved toward each other (as controlled by controller 4) by moving carriage members 36 along the rail 44 of the finger support block 36. This causes a portion of an individual fabric sheet 60 from a stack of fabric sheets 70 to become pinched or trapped between the engaging surfaces of the pinchers 48 (as shown in FIG. 1D). As previously noted, the engaging movement of the pinchers 48 toward each other can be controlled such that the timing of such movement occurs at any given location of the grippers 10 in relation to the fabric sheet 60 (e.g., at the end of downward travel movement of the grippers toward the fabric sheet, as the grippers are approaching the end of downward travel movement toward the fabric sheet, and/or as the grippers begin an upward movement away from the stack 70 of fabric sheets).

At 425, the single fabric sheet 60, having its portions pinched or trapped between pinchers 48 of two or more grippers 10, is raised from the fabric sheet stack 70 by automatic movement of the grippers 10 away from the stack 70 as shown in FIG. 1E (e.g., controller 4 controls movement of guide element 200 upward and away from the stack 70 of fabric sheets while the grippers 10 retain their hold on the fabric sheet 60 via the pinchers 48).

At 430, the single fabric sheet is transported to a different location or station in the system 2 for further processing. In example embodiments, the fabric sheet can be processed to form an article of apparel, such as a T-shirt (e.g., a single ply cotton T-shirt), a jersey, shorts or pants, etc. The processing can comprise combining the single fabric sheet with one or more other fabric sheets and/or other materials (e.g., via sewing, stitching, laminating and/or heat welding operation), embossing or printing indicia such as designs, patterns, logos, etc. on a surface of the single fabric sheet, etc. In an example embodiment of the invention, the grippers can be integrated in a system that can comprise a heat transfer machine for printing indicia on textiles, such as machine commercially available under the trade name TREKK HT300 (Trekk Equipment Group, Missouri, USA).

The system 2 can be configured such that the grippers 10 transport the single fabric sheet 60 in vertical, horizontal and rotational directions (e.g., in six degrees of freedom) to another station or location within the system for further processing. The system 2 can also be configured such that the grippers 10 vertically move the single fabric sheet 60 from the stack 70 and then place the single fabric sheet 60 onto a platform that is moved into position below the grippers 10. For example, a single fabric sheet 60 can be vertically raised by the grippers, followed by movement of a movable platform automatically into position beneath the grippers and raised fabric sheet, and then placing the sheet by the grippers onto the movable platform. The final portion of step 430 involves release of the single fabric sheet from the grippers 10, where the pinchers 48 are automatically moved away from each other (where movement of the pinchers 48 is controlled by the controller 4) to release the pinching hold on the single fabric sheet 60, followed by moving the grippers 10 away from the newly positioned fabric sheet (i.e., by controlling movement of the guide element 200 by the controller 4). In an embodiment in which a movable platform is utilized, the pinching hold on the single fabric sheet can be released by the grippers followed by movement of the movable platform away from the grippers and/or movement of the grippers away from the movable platform.

It is noted that each of the grippers 10 can be operated to move and pinch the fabric surface in sync or substantially simultaneously with each other during system operation (e.g., during the process steps 415-430). Such simultaneous movement and operation of the grippers 10 can be achieved regardless of whether the grippers are disposed on the same guide element 200 or on two or more different guide elements 200. In other embodiments and depending upon the requirements for certain applications, the movements of some of the grippers can be staggered (i.e., not in sync) with other grippers. This can be achieved, e.g., in systems in which some grippers 10 are disposed on two or more guide elements 200 (e.g., where the guide elements are not moved in sync but instead the movement of one guide element is slightly staggered in time in relation to the movement of another guide element).

Thus, the automated picking system facilitates picking of a single material sheet, such as a very thin/low basis weight sheet of fabric (e.g., a single ply sheet of fabric) or other material directly from a support surface or from a stack of material sheets and transport the single sheet to another location for further processing. This automated process provided by the system alleviates issues associated with typical processing of single sheets of material (e.g., where conventional techniques require human interaction, where a human typically picks a single material sheet from a support surface or from a stack and manually moves the sheet to another location for further processing).

While the invention has been described in detail and with reference to specific embodiments thereof, it will be apparent to one skilled in the art that various changes and modifications can be made therein without departing from the spirit and scope thereof.

For example, the variability or adjustability of features associated with the grippers 10, which facilitates fine tuning or granular adjustment of force/pressure applied by the pinchers 48 to a material sheet surface, allows the system to be utilized for picking textile items and/or other flexible materials having a variety of different thicknesses and/or basis weights. In addition, the system can be configured to change an amount of force/pressure applied to a material sheet to be picked during system operation (i.e., in real time). This can be accomplished, e.g., by simply changing the distance at which the grippers 10 are moved toward and into contact with a sheet surface. for example, this allows for material sheets having different thicknesses and/or different basis weights and that are within a single stack of sheets (or at different locations on a support surface) to be picked and processed without requiring the system to be taken offline and adjusted (i.e., the system can pick and process different types of material sheets consecutively and in real time without having to stop the picking process).

There are a number of ways in which the controller 4 can be configured to identify the material type for the next material sheet 60 to be picked (e.g., in a stack 70 or, alternatively, at different placement locations along a support surface) and then adjust one or more system parameters to modify the force and/or pressure applied to the next material sheet accordingly. For example, a stack of sheets may include a first number of a first type of fabric sheets (e.g., single ply woven fabric) followed by a second number of a second type of fabric sheets (e.g., two ply woven fabric) disposed below the first number of sheets, where the controller 4 maintains a count of number of fabric sheets picked such that the controller can adjust the downward movement distance of the grippers 10 (which results in a change of the force/pressure applied to the next fabric sheet to be picked). In another example, fabric sheets can include some form of indicia (e.g., bar code, color code, etc.) that represents the fabric type and that is disposed at a selected location on the exposed surface of each sheet (e.g., at or near a sheet corner) that can be detected (e.g., utilizing a suitable detector) and identified (e.g., by the controller 4). The identification of the fabric type can be used by the controller 4 to adjust the force/pressure applied by the grippers 10 to the next fabric sheet 60 to be picked.

Thus, it is intended that the present invention covers the modifications and variations of this invention provided they come within the scope of the appended claims and their equivalents. It is to be understood that terms such as "top," "bottom," "front," "rear," "side," "height," "length," "width," "upper," "lower," "interior," "exterior," "medial," "lateral," and the like as may be used herein, merely describe points of reference and do not limit the present invention to any particular orientation or configuration.

What is claimed:

1. A method of picking a single material sheet from a support member that comprises a stack of vertically aligned material sheets, and the single material sheet comprises an uppermost material sheet disposed on the stack, the method comprising:

aligning a gripping member above the support member, wherein the gripping member comprises a pair of spaced apart pinching members movably coupled with a main frame, and each pinching member includes an exposed gripping surface that is substantially planar and that faces an exposed surface of the single material sheet;

moving the gripping member toward the exposed surface of the material sheet such that the gripping surfaces of the pinching members engage a portion of the material sheet;

moving the pinching members for the gripping member toward each other while the pinching members engage the portion of the material sheet so as to pinch the portion of the material sheet between the pinching members; and moving the gripping member away from the support member while the pinching members for the gripping member pinch the portion of the material sheet so as to vertically displace the material sheet from the support member.

2. The method of claim 1, further comprising:

determining a distance D1 between the gripping surface of one of the pinching members and the exposed surface of the material sheet;

wherein the gripping member is moved toward the exposed surface of the material sheet based upon the determined distance D1.

3. The method of claim 2, wherein the distance D1 is determined based upon a distance D2 that is measured between a detector for the gripping member and the exposed surface of the material sheet.

4. The method of claim 3, wherein the distance D2 is measured utilizing a laser distance sensor.

5. The method of claim 2, wherein the gripping member is moved toward the material sheet such that the gripping surface of the one of the pinching members is moved a distance that is greater than the distance D1.

6. A method of picking a single material sheet from a support member the method comprising:

aligning a gripping member above the support member, wherein the gripping member comprises a pair of spaced apart pinching members movably coupled with a main frame, and each pinching member includes an exposed gripping surface that is substantially planar and that faces an exposed surface of the single material sheet;

moving the gripping member toward the exposed surface of the material sheet such that the gripping surfaces of the pinching members engage a portion of the material sheet;

moving the pinching members for the gripping member toward each other while the pinching members engage the portion of the material sheet so as to pinch the portion of the material sheet between the pinching members; and moving the gripping member away from the support member while the pinching members for the gripping member pinch the portion of the material sheet so as to vertically displace the material sheet from the support member;

wherein a distance between the pinching members of the gripping member is from about 2.54 mm to about 3.30 mm.

7. A method of picking a single material sheet from a support member the method comprising:

aligning a gripping member above the support member, wherein the gripping member comprises a pair of spaced apart pinching members movably coupled with a main frame, and each pinching member includes an exposed gripping surface that is substantially planar and that faces an exposed surface of the single material sheet;

moving the gripping member toward the exposed surface of the material sheet such that the gripping surfaces of the pinching members engage a portion of the material sheet;

moving the pinching members for the gripping member toward each other while the pinching members engage the portion of the material sheet so as to pinch the portion of the material sheet between the pinching members; and moving the gripping member away from the support member while the pinching members for the gripping member pinch the portion of the material sheet so as to vertically displace the material sheet from the support member;

wherein the material sheet comprises a single ply fabric material.

8. The method of claim 1, further comprising:

adjusting a parameter associated with alignment of the gripping member, movement of the gripping member, and movement of the pinching members toward each other based upon a type of material sheet to be vertically displaced from the stack.

9. The method of claim 1, further comprising:

utilizing a plurality of gripping members to vertically displace the material sheet from the support member.

10. An automated system for picking a single material sheet from a support member, the system comprising:

a gripping member comprising a main frame, and a pair of finger members movably coupled to the main frame, wherein each finger member comprises:

a carriage member that is secured to and movable along a rail of the finger member; and a pinching member coupled with the carriage member, wherein the pinching member includes an exposed lower gripping surface that is substantially planar;

wherein:

the pinching member for each finger member is movable, via the corresponding carriage member, toward the pinching member of the other finger member so as to facilitate engaging contact between facing sides of the pinching members during system operation; and the gripping member further comprises a second carriage member that is secured to and movable along a rail and between a first end and a second end of the main frame, wherein the second carriage member is further secured to the finger member to facilitate movement of the finger member relative to the main frame.

11. The system of claim 10, further comprising:

a controller that controls movement of the pinching members of the gripping member toward each other during system operation.

12. The system of claim 11, further comprising:

a detector coupled with the controller, wherein the detector determines a distance D1 between the gripping surface of one of the pinching members and an exposed surface of a material sheet disposed below the pinching members;

wherein the controller controls movement of the gripping member toward the exposed surface of the material sheet based upon the distance D1 determined by the detector.

13. The system of claim 12, wherein the controller controls movement of the gripping member toward the exposed surface of the material sheet such that the gripping surface of one of the pinching members is moved a distance that is greater than the distance D1.

14. The system of claim 10, wherein a movable direction of the second carriage member is transverse a movable direction of the carriage member.

15. The system of claim 10, wherein the gripping member further comprises:

a resilient member coupled with the main frame to bias the second carriage member in a direction away from the first end of the main frame.

16. The system of claim 10, wherein each pinching member comprises a material having a Shore A hardness durometer value from about 30 to about 80.

17. The system of claim 10, wherein each pinching member comprises polyurethane.

18. The system of claim 10, further comprising a plurality of gripping members.

* * * * *